US006517383B2

(12) United States Patent
Watson

(10) Patent No.: US 6,517,383 B2
(45) Date of Patent: Feb. 11, 2003

(54) IMPEDANCE-CONTROLLED HIGH-DENSITY COMPRESSION CONNECTOR

(76) Inventor: Troy M. Watson, 7052 E. 2nd St., Tucson, AZ (US) 85710

( * ) Notice: Subject to any disclaimer, the term of this patent is extended or adjusted under 35 U.S.C. 154(b) by 0 days.

(21) Appl. No.: 10/042,637

(22) Filed: Jan. 9, 2002

(65) Prior Publication Data

US 2002/0068482 A1 Jun. 6, 2002

Related U.S. Application Data

(63) Continuation-in-part of application No. 09/406,471, filed on Sep. 27, 1999, now abandoned.

(51) Int. Cl.[7] ..... H01R 13/648

(52) U.S. Cl. ..... 439/608; 439/78; 439/943

(58) Field of Search ..... 439/608, 78, 943, 439/289, 55, 876, 82, 733.1, 750; 174/267, 261

(56) References Cited

U.S. PATENT DOCUMENTS 5,030,134 A * 7/1991 Plosser ..... 439/434
5,154,626 A * 10/1992 Watson ..... 439/268

* cited by examiner

*Primary Examiner*—Tho D. Ta
*Assistant Examiner*—Edwin A. Leon

(57) ABSTRACT

A compression attachment/contact system, for interconnecting microelectronic circuits and cable assemblies, provides capability of electrical shielding, characteristic-impedance control, and resistive loading and dampening. It utilizes cylindrical conducting elements that can be configured in high-density multi-connector arrays that are mounted in cylindrical through-openings provided of a housing panel. Each conducting element can be made resistive to affect a series resistor within the connection or be highly conductive for minimum electrical power loss. Each conducting element has an opposing attachment end and contact end. The attachment end can be made in different shapes to receive stripped interconnecting wire. The contact end electrically engages an external mating connector, where engagement is either applied under pressure or attached with solder or a weld. Each conducting element is surrounded by a tubular sleeve fitted into the cylindrical through-opening of the housing panel. The sleeve can be configured to have a specific parallel resistance to provide loading/signal-termination to ground, or, have a specific dielectric constant to affect the capacitance of the conducting element to ground. The housing panel can serve as a low-impedance reference plane such as for ground or electro-static shielding, or alternatively be magnetically permeable for electro-magnetic shielding.

35 Claims, 5 Drawing Sheets

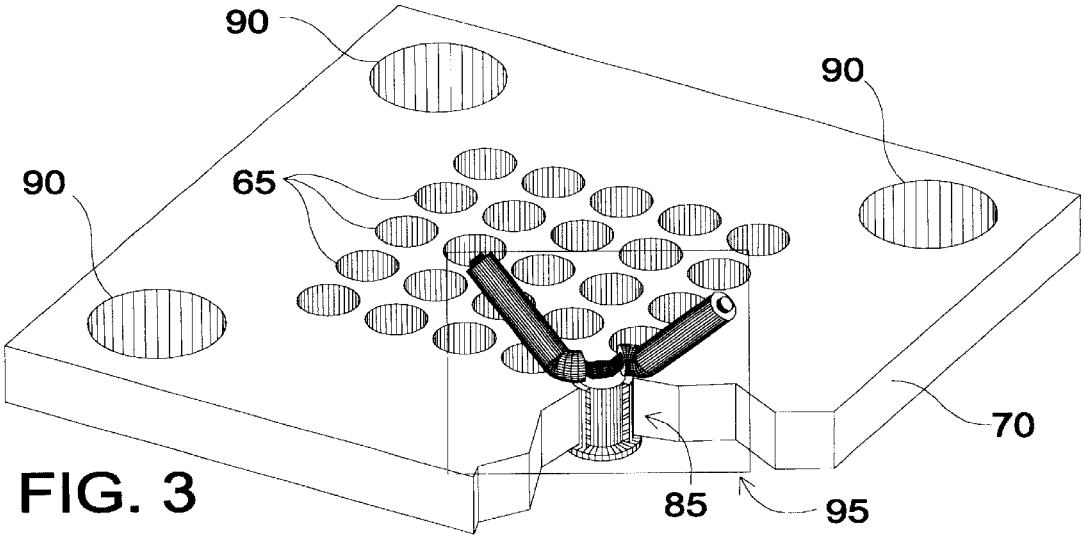
FIG. 3
FIG. 4
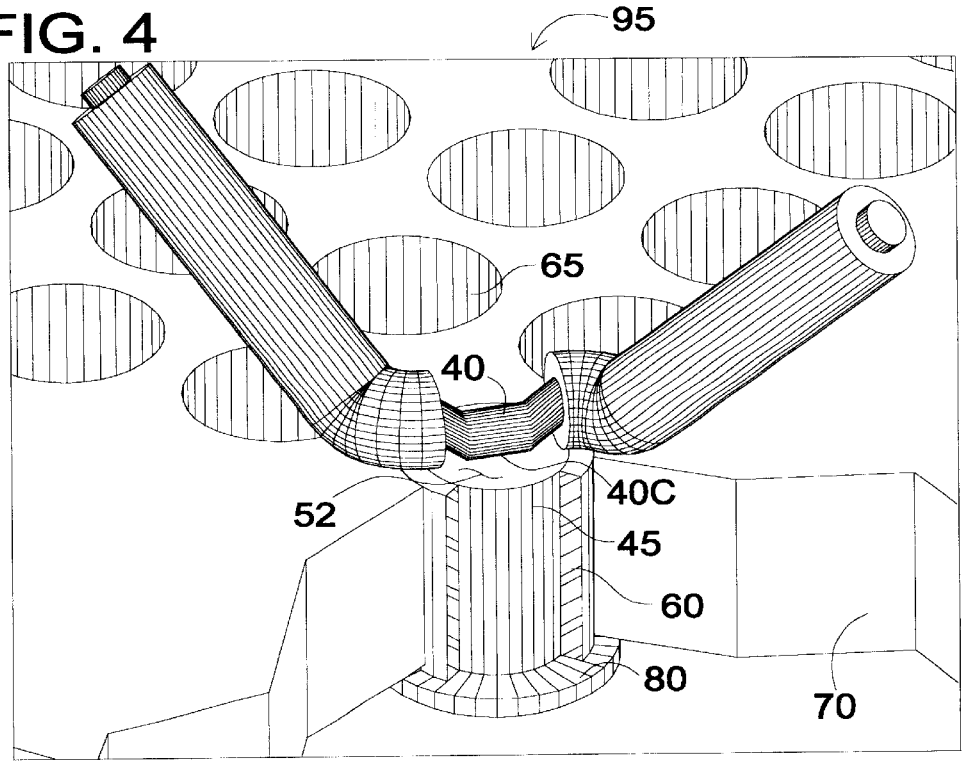

IMPEDANCE-CONTROLLED HIGH-DENSITY COMPRESSION CONNECTOR

FIELD OF THE INVENTION

This application is a continuation-in-part of U.S. Ser. No. 09/406,471 entitled "HIGH-DENSITY COMPRESSION CONNECTOR WITH RESISTIVE OPTION" filed Sep. 27, 1999, now abandoned. It improves on the utility of Ser. No. 09/406,471 where parallel resistance and impedance control are incorporated into the connector assembly. The end-goal is to provide a connector assembly having an ability to match the characteristic impedance of the connection to the impedance of the driving device and the impedance of the receiving device. It is intended to be a high density, multi-connector array.capable of handling high frequency and/or high speed digital signals.

BACKGROUND OF THE INVENTION

Because present trends in designing microelectronic devices and circuits are toward increased miniaturization, higher component density and greater number of component leads per piece-part, there is a corresponding need for connectors that can be configured in high-density, large-number arrays. Techniques known in the art for providing high-density interconnections between an integrated circuit (IC) or multi-chip module (MCM) and a printed wiring board (PWB) include using a quad flat-pack (QFP) which surrounds an integrated circuit (IC) or multi-chip module (MCM) on four sides with wire/lead interconnections, and using a leadless chip-carrier (LCC) which surrounds the four outer planes of an IC/MCM with vertical, flush, interconnecting leads. High-density interconnection techniques wherein connections are arranged in a two-dimensional array located under or near the substrate of an IC/MCM or the base of a PWB include the use of land grid arrays (LGA's), ball grid arrays (BGA's), and pin grid arrays (PGA's). LGA's and BGA's have become popular in part arrays (PGA's). LGA's and BGA's have become popular in part because production equipment used to mount and solder surface-mount devices onto circuit boards can be easily adapted. This ease of manufacture is enhanced by the tendency of BGAs during soldering to self-align because of the effects of surface tension caused from the molten solder.

Chip-scale packaging is another emerging technique for interfacing an IC to a substrate/circuit board. Still in its infancy, this technology has the potential to cost-effectively provide direct connections between package or circuit board input/output (I/O) pads to IC die or MCM substrates.

Because circuit miniaturization and high-density components entail ever-increasing signal speeds and input/output rates, newly developed devices increasingly require interconnections that can provide adequate shielding and maintain a proper and uniform characteristic impedance. These properties are particularly necessary to pass low-noise signals or signals with fast edges ($\Delta v/\Delta t$). In PWB design, characteristic impedance control has been achieved by using strip-line or micro-strip techniques which requires careful control of the size, position and spacing of circuit traces within a dielectric away from a ground or reference plane. However, applying strip-line or micro-strip connections to the inner pads of a high-density PWB becomes more difficult as circuit density increases. Also, more layers and increased manufacturing must be used when a device includes numerous, high-density, shielded and/or impedance-controlled interconnections. Increased circuit density requires more connections per unit area, especially if numerous ground planes (as required when using micro-strips or strip-lines) are utilized.

The need to interconnect to electronic components and their receptacles with impedance-controlled transmission lines is increasing with increasing clock speeds and as the density of electronic devices increase. If the impedances between the output impedance, transmission line and input impedance are not uniform, then reflections are created that decreases signal integrity and increases electromagnetic interference (EMI).

In addition, there is an increased need to integrate as many support functions in with the electronic devices to enable higher integration. Such functions include series dampening resistors and parallel loading.

DESCRIPTION OF KNOWN ART

U.S. Pat. No. 4,679,321 to J. P. Plonski describes an interconnection board for high frequency signals wherein connectors are in close proximity. The board is constructed having one side provided with a ground plane and the other side provided with terminal pads and interconnection conductors. Holes are drilled through the board at the terminal points. An end of the center conductor of a coaxial cable, stripped of insulation, is inserted through each hole while the conductive shield remains on the other side of the board. Each bare-wire conductor is connected to a pad and the conductors are scribed and bonded into place. The shields can be interconnected by applying a plated copper layer or a conductive encapsulating layer or by reflow soldering.

U.S. Pat. No. 3,114,194 to W. Lohs describes a method of wiring an electrical circuit upon an insulating plate provided with a plurality of holes, whereby wire lengths are kept as short as possible and wires can be crossed. Insulated wire is drawn through a hole in the plate and a loop formed from the wire projecting through the hole. The loop is then crushed to simultaneously anchor the loop into the hole and expose a conductive area.

U.S. Pat. No. 5,042,146 ('146) by the present inventor, discloses a process and apparatus for forming double-helix contact receptacles directly from insulated wire for interconnecting components independent of printed circuitry. Some of the apparatus disclosed therein, specifically the wire processing mechanism including cutting, stripping, and handling assemblies, is readily adaptable to the present invention which, like the '146 patent, is capable of handling and incorporating both single and twisted-pair insulated wire. Alternatively, coaxial cable can be used with the center conductor in lieu of a single conductor, provided the shield does not contact the center conductor.

U.S. Pat. No. 5,250,759 ('759), also by the present inventor, for SURFACE MOUNT COMPONENT PADS, is incorporated herein by reference in its entirety; '759 discloses a method to form pads for surface-mount electronic components by inserting a stripped portion of insulated wire into an elongated rectangular opening, and anchoring the U-shaped loop thus formed into place with epoxy or a plug. Although the pads disclosed in the '759 patents can be used with area arrays, their elongated pads will not mesh well geometrically with the square pads normally used in arrays. In addition, due to their shape, elongated pads cannot be disposed sufficiently dense in planar arrays to meet the close proximity requirements of LGA's or BGA's.

U.S. Pat. No. 5,755,596, also by the present inventor, for a HIGH-DENSITY COMPRESSION CONNECTOR, is also incorporated herein by reference in its entirety, discloses a method to form contact receptacles for high-density area arrays and connectors from sections of insulated wire. In this patent a stripped section of insulated wire is formed into a short loop, this loop inserted into an insulating sleeve, and this insulating sleeve is inserted into a receptacle of a housing.

U.S. Pat. No. 6,010,342 entitled SLEEVELESS HIGH-DENSITY COMPRESSION CONNECTOR, a continuation-in-part of '596, where the insulation portion of insulated wire takes the place of the insulating sleeve. Both the '596 and '342 patents use wire segments or loops as the central conductive elements but do not provide for the incorporation of resistive elements.

U.S. patent application Ser. No. 09/406,471 entitled "HIGH-DENSITY COMPRESSION CONNECTOR WITH RESISTIVE OPTION" filed Sep. 27, 1999 describes a pin-type compression connector that details an optional resistive element that is placed in series with the connection. The issue of characteristic impedance is discussed as a goal in this application but details on how the characteristic impedance can be varied is not discussed.

OBJECTS OF THE INVENTION

It is a primary object of the present invention to provide a mechanically rugged multiple connector assembly with capability to incorporate a controlled amount of series resistance and resistance to ground.

It is a another object of the present invention to provide a multi-unit connector assembly allowing limited control of the characteristic impedance of each signal in a high-density connector array.

Another object is to provide an ability to interconnect electronic circuit and cable assemblies by means of compression of one contact element to another.

A further object is to provide a multiple connector capable of providing shielding between all elements of the connector array.

Another object is to provide a multi-unit connector that is simple to manufacture and repair.

Another object is to achieve high density and ability to interconnect to contemporary microelectronic circuits and devices such as interconnect pads of surface-mount, area-arrayed electronic devices including ball-grid arrays, land-grid array, chip-scale or flip-chip packages.

Yet another object is to provide a multi-unit connector that is reliable and easy to use.

SUMMARY OF THE INVENTION

These and other objects are achieved by the present invention, a compression-contact connector assembly implemented as a plurality of cylindrical electrically conducting elements mounted in an array of cylindrical through-openings in a housing panel. The housing panel can be electrically conductive to serve as a ground reference (or other electrical reference), to provide a path for parallel loading, and/or to facilitate the shielding of orthogonal electrostatic forces. The housing panel can also be magnetically permeable to allow the conduction of magnetic lines of force, thereby facilitating H-field shielding. The electrically conductive element has one end configured to attach to a bared portions of interconnection wire on one side of the housing panel and the opposite end configured as a contact surface. The electrically conductive elements can be made highly conductive or can be made to have a specified resistance value. For the purpose of this disclosure, the term resistance is defined as any electrical resistance greater than 0.1 ohm, the term electrically conductive is defined as any electrical resistance less than 0.1 ohm. In particular, reference to resistive within these parameters is intended to refer to the use of a component as a resistor rather than a conductor, that is, adding resistance that ordinarily would not exist in a component. The attachment end can be made in several alternative configurations directed to coaxial or flat ribbon type interconnection wire in either unshielded or shielded versions. The contact end can be made in various shapes: e.g. planar, concave to engage solder balls, convex, or pointed to penetrate non-conductive coatings. The contact ends in an array can be kept aligned in a plane by an attached annular flange surrounding each conducting element near the contact end.

BRIEF DESCRIPTION OF THE DRAWINGS

FIG. 3 shows a single receptacle situated in a multi-unit housing panel.

FIG. 4 is an enlargement of a portion of FIG. 3.

DETAILED DESCRIPTION

Figure 1:
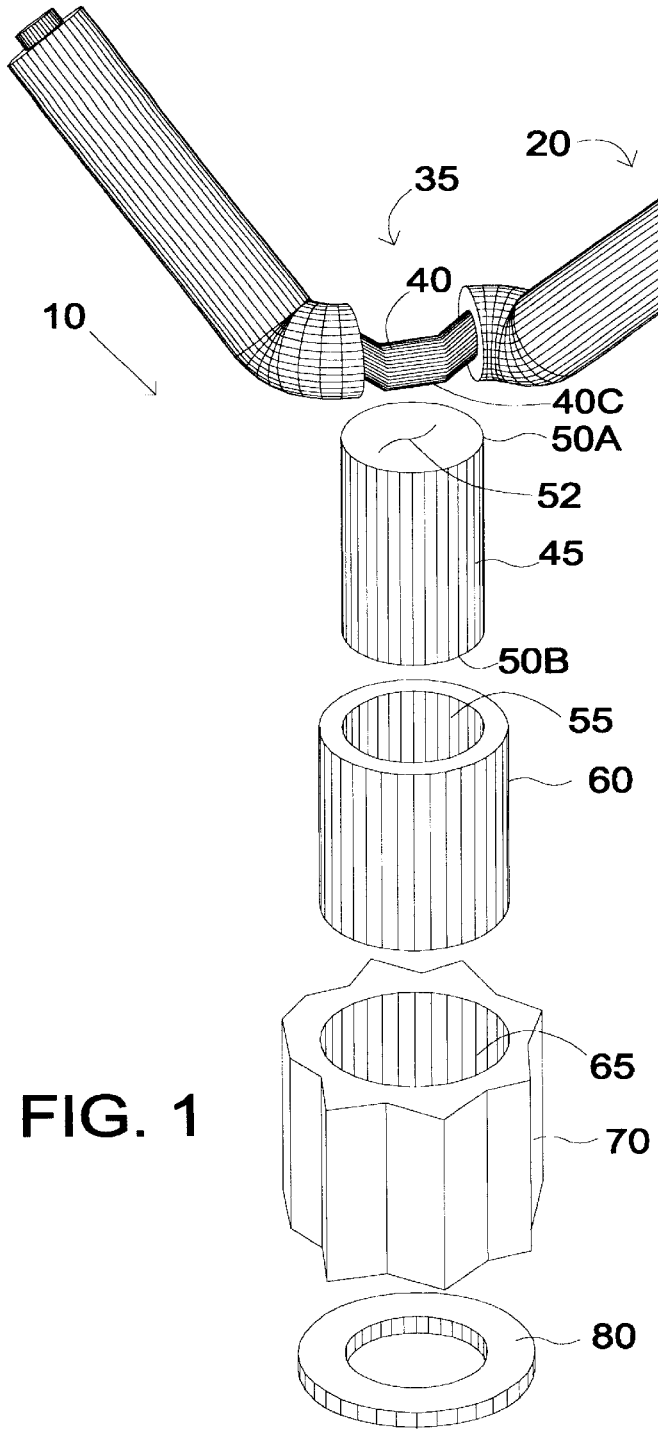
FIG. 1 is an exploded three-dimensional view of a connector assembly in a first embodiment of the present invention, with partially bared hookup wire.

FIG. 1 is an exploded three-dimensional view of a connector assembly 10, in a first embodiment of the present invention that provides high frequency capabilities, consisting of insulated wire 20 having an inner conductor 25 and an outer insulating cover 30. A portion of insulation 30 is removed from the insulated wire in the area of wire segment 35 to expose bared wire 40. The area of bare-wire segment 40C is soldered, welded, or epoxied to the attachment end 50A of the central electrically conducting element 45 to surface 52. Central conductive element 45 can be made maximally conductive or can be made to have a specific resistance value so as to introduce series resistance within a transmission line, in accordance with a common design practice to suppress signal reflections and ringing.

Opposite the attachment end 50A of central electrically conducting element 45, the contact end 50B is made to provide a contact surface held under pressure against an opposing mating contact surface or object (not shown) which can be an opposing similarly configured connector assembly or a pad of a ball-grid array, land-grid array, chip-scale or flip-chip package. Alternatively, contact end 50B can be soldered or welded to the opposing mating contact surface to provide an improved and more permanent interconnection.

The central electrically conducting element 45 is inserted into cavity 55 of sleeve 60, and sleeve 60 is installed into receptacle 65 of housing panel 70. With housing panel 70 electrically-conductive, sleeve 60 can be a dielectric material to affect the capacitance between electrically conducting element 45 and the electrically-conductive housing panel 70 or have a predefined resistance to provide parallel resistance to the electrically conductive housing panel 70. By incorporating the load resistance in the sleeve, termination is achieved directly at the package interface, thereby reducing RF stub-lengths.

In the application of high-speed interconnections the impedance of the transmission line should equal the impedance of the output driving device which also should equal the impedance of the receiving device(s). Properly matching the impedances of these three components reduces signal reflections and thereby decreases electro-magnetic interference and increases signal integrity. The characteristic impedance of each connector is affected by the mutual capacitance and inductance existing between the (opposing) signal paths as well as any other resistance that may exist. It is known to one skilled in the art of transmission-line theory that for low-resistance transmission lines the impedance Z=SqRt(L/C), with L being the inductive component and C being the capacitive component. The mutual capacitance and inductance between the (opposing) signal paths is affected by the geometry and materials used in the connector. The common surface area shared between conducting element 45 and housing panel 70, separated by sleeve 60 that has a selected dielectric constant and thickness affects the capacitance. By controlling the magnetic (inductive) link between opposing electromagnetic fields created by the proximity between signal and its return currents (and fields), as well as the current (and field) densities involved, the inductance is affected. By controlling the resistance of conductive element 45, the series resistance of the connection is provided. By controlling the resistance of sleeve 60, parallel resistance and loading is provided. It is this geometry and interrelationship between conducting element 45, sleeve 60 and housing panel 70, as well as the series and parallel resistance of conducting element 45 and sleeve 60 by which the characteristic impedance of the connector is defined. The characteristic impedance is a vectored-sum value comprised of real and imaginary components of a complex number. The resistance affects the real component and the capacitance and inductance affects the imaginary component. In any particular assembly each connector unit can have different impedance values in order to meet the requirement of the overall assembly. As an example, power and ground connections generally require a low-impedance connection while signal lines often require distinct values of impedance values.

With each central element 45 surrounded by conductive housing 70, housing 70 is a coaxial shield between each central element 70. The ability of coaxially surrounding each connector element with a shield can also be used in low-frequency analog applications where typically noise-suppression is more important than characteristic impedance control. Alternative methods for coaxial cable shielding can be obtained in a non-conductive housing panel by the addition of a sleeve having a non-conductive cylindrical interior surface and having a conductive outer surface, coaxial to the inner surface. This conductive outer surface can be sputtered, sprayed or otherwise attached to the outer surface of the sleeve which surrounds the non-conductive sleeve. In such a connector assembly the outer shield within the connector serves as an extension of the interconnecting coaxial cable.

While an electrically conducting housing panel 70 can serve as an electro-static shield for e-field shielding between individual conducting elements 45, housing panel 70 can also consist of a magnetically permeable material to provide shielding for lower frequency, current induced electro-magnetic h-fields. Combinations of and degrees of the electro-magnetic permeability and electro-static permittivity of housing panel 70 is possible. Housing panel 70 can be constructed to have magnetically permeable properties with electrically non-conductive properties by emulsifying a magnetically permeable material into a non-conductive binding. Alternatively, housing panel 70 can have electrically-conductive properties with magnetically permeable properties by using a solid magnetically permeable metal, such as nickel or iron, for the housing.

Figure 2:
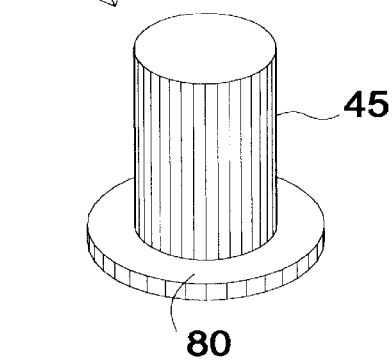
FIG. 2 is a three-dimensional view showing the central electrically conducting element and the non-conductive flange of FIG. 1, assembled together.

FIG. 2 is a three-dimensional view of a conductor assembly 85 consisting of the central electrically conducting element 45 and the non-conductive flange 80 of FIG. 1. The unified contact/flange assembly 85 having a flange 80 is integrated with the lower portion of central electrically conducting element 45. Flange 80 can be attached to central electrically conducting element 45 by welding, epoxy, press fit, or be retained by a groove within the central conductive element 45. The increased diameter of flange 80 is required to prevent the central electrically conducting element 45 from being withdrawn from receptacle 65 of housing panel 70, and to provide a uniform plane for alignment of the contact ends 50B to ensure proper, uniform pressure for reliable electrical contact with an opposing array of electrical contact elements.

FIG. 3 is a three-dimensional view of a multi-unit housing panel 70 partially cut-away to show a single conductor assembly 85 mounted in a cylindrical opening 65. Alignment holes 90 shown at the corners of housing panel 70 are provided to accept alignment guide pins (not shown) of a mating multi-contact array (not shown). The compression of opposing housing panels 70 can be through spring tension of an outer clamp (not shown). One method references the edges of opposing connector assemblies similarly dimensioned for uniform distance of the contact assembly array from housing panel 70.

FIG. 4 is an enlargement of area 95 of FIG. 3 showing each of the elements in its working position: bared wire segment 40 in the attachment region 52 bonded at 40C with conductor assembly 85 (conductive element 45 and flange 80) surrounded by sleeve 60 to serve as a dielectric or resistive material between element 45 and the metal housing panel 70. Not visible in this view is the contact surface at the bottom end of the conducting element 45, opposite the attachment region 52 at the top.

Figure 5:
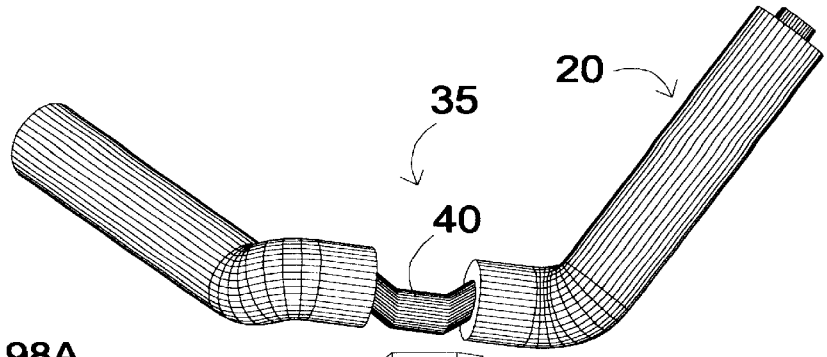
FIG. 5 is a three-dimensional under-view of a receptacle assembly as in FIG. 4, shown separated from the hookup wire, and showing the central electrically conducting element configured with a flat bottom contact surface.
Figure 5:
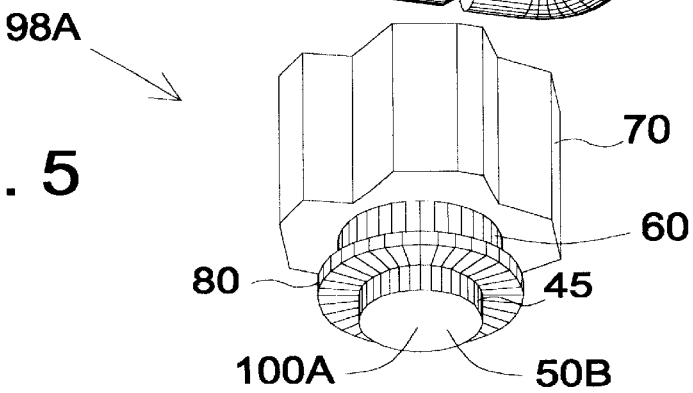
Figure 6:
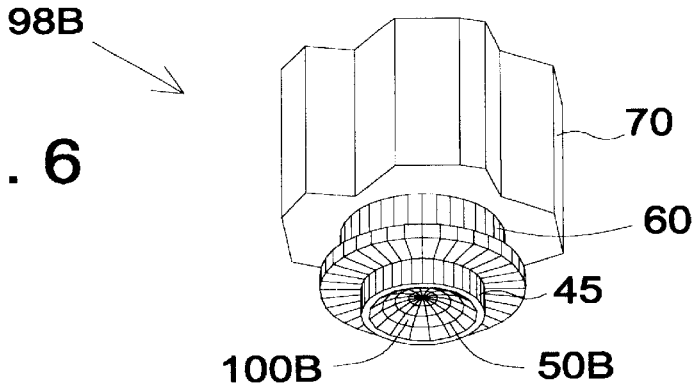
FIG. 6 shows the receptacle assembly as in FIG. 5 but with the contact end of the central electrically conducting element shaped with a concave cavity for engaging and contacting a solder ball.
Figure 7:
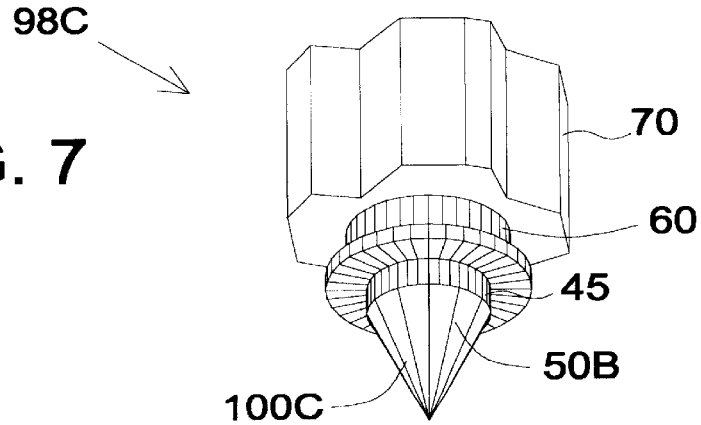
FIG. 7 shows the receptacle assembly as in FIG. 5 but with the central electrically conducting element configured with an outward conical surface forming a pointed contact element.

FIGS. 5–7 show an underview of the single conductor assembly with different shaping of the electrical contact surface 50B. The central conductive element 45 is extended downward slightly beyond flange 80, with both flange 80 and sleeve 60 slightly extending beyond the plane of housing panel 70. Connector assemblies 98A, 98B, or 98C can serve as a multi-use connector or the contact surface 50B can be soldered, welded, or alternatively be bonded to the opposing contact surface. The contact surface 50B can be plated with an appropriate metal (such as a noble metal) to protect against oxidation or be plated with a hard metal to increase wear characteristics.

FIG. 5 is a three-dimensional under-view of a connector assembly 98A, generally as shown in FIG. 4 but spaced apart from the hookup wire 40, and showing the central electrically conducting element 45 having its bottom end 50B configured with a flat planar surface 100A.

FIG. 6 shows the connector assembly generally as in FIG. 5 but with the contact end 50B at the bottom of central electrically conducting element 45 configured to shape the contact surface 100B as a shallow concave cavity that is particularly suitable for contacting solder balls of ball-grid arrayed device (not shown) without deforming and damaging the soft solder balls.

FIG. 7 shows the connector assembly as in FIG. 5 but with the contact end 50B of central electrically conducting element 45 shaped to have a conical surface 100C providing a pointed contact element that is particularly suited for penetrating any coating or oxidation of the opposing contact assembly.

Figure 8:
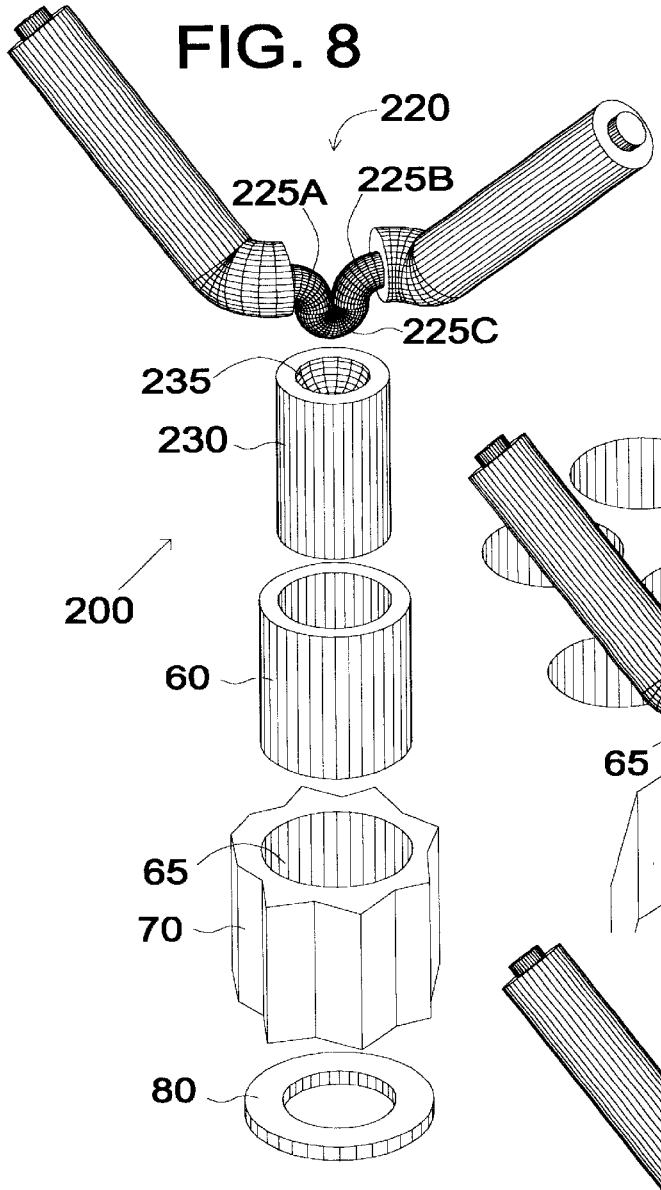
FIG. 8 is an exploded view of an alternative version of the connector assembly as in FIG. 1 but having a spherical attachment cavity formed in the top end of the conductive element.

FIG. 8 is an exploded view of an alternative connector unit 200 positioned to receive insulated wire from which a segment of outer insulating cover is stripped as shown to bare the wire segment 220 consisting of two 90° sections 225A, 225B situated between a bridging 180° section 225C. The 180° section 225C is welded, soldered, or otherwise bonded into a spherically shaped cavity 235 formed in the connection end at the top of central electrically conducting element 230, which is then installed into sleeve 60 which in turn is installed into cylindrical opening 65 of housing panel 70. To provide shielding for voltage-induced e-fields, housing panel 70 can be made of an electrically conductive material. To provide shielding for current-induced h-fields, housing panel 70 can be made of a magnetically permeable material.

Figure 9:
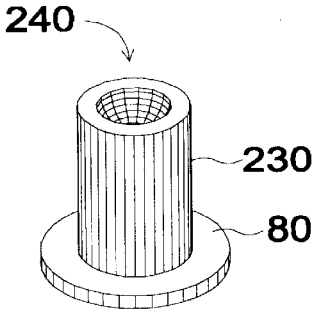
FIG. 9 is a three-dimensional view of two elements of FIG. 8 assembled together: the central electrically conducting element and the non-conductive flange.
Figure 10:
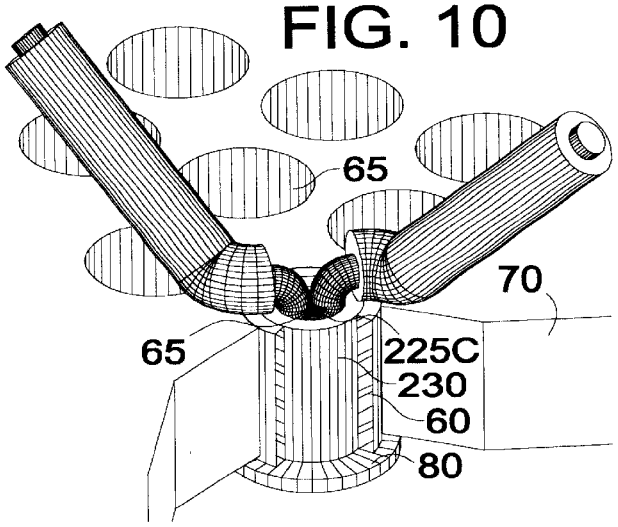
FIG. 10 is a three-dimensional view of the connector assembly of FIG. 8 assembled and installed in a multi-unit housing panel with the bared region of the hookup wire inserted into the attachment cavity.

FIG. 9 shows a conductor assembly 240 formed from two elements of FIG. 8: annular flange 80 is epoxied, pressed onto, or otherwise attached to the lower portion of central electrically conducting element 230, forming assembly 240 which is an alternative version of assembly 85 of FIG. 2, FIG. 10, equivalent to indicated region 95 of FIG. 3 and FIG. 4, is a three-dimensional view of the elements of single contact assembly 200 of FIG. 8, including conducting element 230 with flange 80 (i.e. the conductor assembly 240 of FIG. 9). The assembled connector assembly of FIG. 8 is installed into a cylindrical opening 65 of a multi-unit housing panel 70 shown partially cut-away, with the U-shaped bared region 225C of the hookup wire inserted into the cavity (235, FIG. 8) of central electrically conducting element 230.

Figure 11:
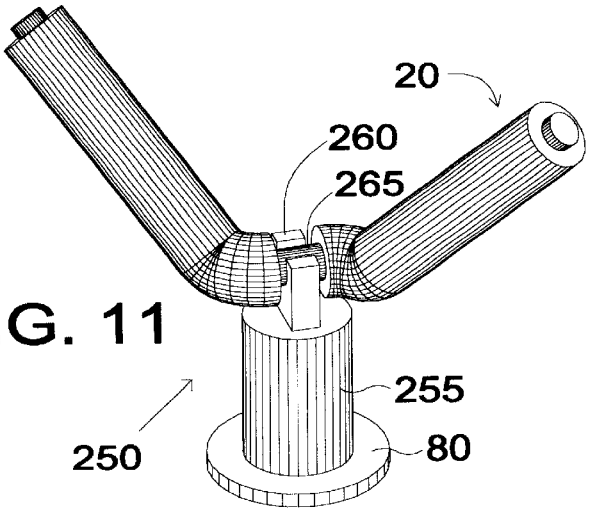
FIG. 11 is a three-dimensional view of the connector assembly of the present invention showing an alternative grooved receptacle at the attachment end of the conducting element.

FIG. 11 is a three-dimensional view of an alternative contact assembly 250 wherein a modified central conductive element 255 is configured with a raised grooved receptacle 260 that connects to the central conductor 265 in a stripped segment of the interconnect wire. Central conductor 265 is attached to and electrically integral to raised groove receptacle 260, which is in turn soldered, welded, crimped or otherwise connected to the bared-wire segment 265 of the interconnect wire. Crimping can include the concepts of insulation displacement in which the insulation is displaced so as to expose central conductor 265 followed by the crimping of bared-wire segment 265 to grooved receptacle 255.

Figure 12:
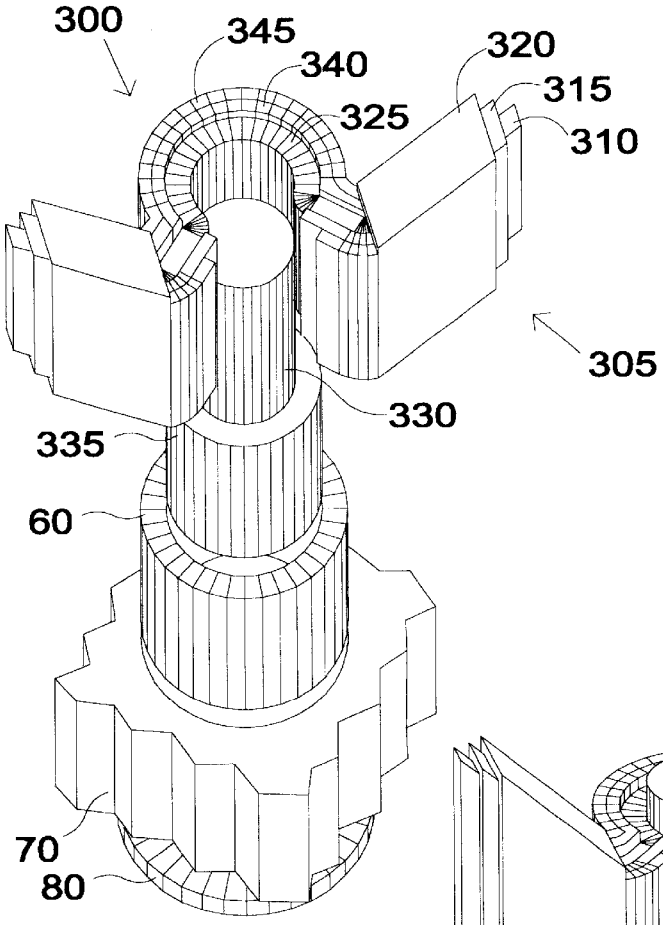
FIG. 12 is an exploded three-dimensional view of a connector assembly unit with the attachment end of the conducting element configured as a post and engaged in a wrap-around manner by a stripped-line ribbon-type conductor.

FIG. 12 shows an exploded three-dimensional view of a unit of an alternative attachment unit 300 which is configured to accommodate a flat shielded ribbon wire 305 that interconnects between attachment units 300. Stripped-line conductor 305 consists of a continuous length of ribbon inner conductor 310 surrounded by an insulating dielectric 315 and an electrical shield 320. Ribbon conductor 310, insulating dielectric 315 and electrical shield 320 are severed after each wiring run consisting of two or more interconnections. A portion of insulating dielectric 315 and electrical shield 320 is removed at section 325 to electrically connect to a post 330 which is in effect a reduced diameter upward conductive extension of conductive element 335. This reduced end in turn makes electrical contact with the contact surface at the contact end at the bottom (not seen in this view) and an opposing mating contact surface. The outer portion of the insulating dielectric 315 and electrical shield 320 remains at looped insulating dielectric 340 and looped electrical shield 345 in order to provide continued electrical and magnetic coupling between the ribbon connector 310 and the electrical shield 320.

Figure 13:
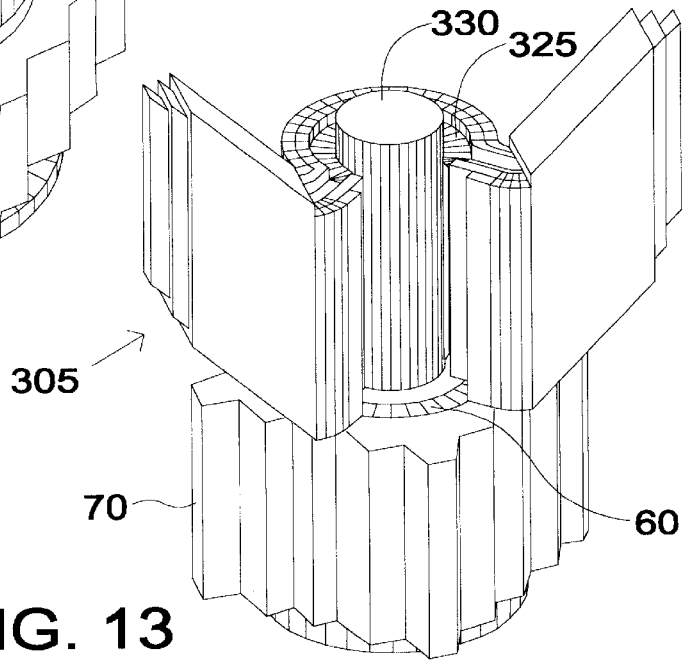
FIG. 13 shows the subject matter of FIG. 12 assembled in place in the housing panel.

FIG. 13 shows the elements of FIG. 12 assembled with sleeve 60 installed into housing 70, stripped-line conductor 305, and looped ribbon conductor 325 partially surrounding reduced central conductive element 330.

Where none of the attachment/contact units require shielding or controlled impedance, the invention can be practiced with housing panel made of non-conductive material and the cylindrical openings sized to fit central element 45 directly, without a sleeve.

This invention may be embodied and practiced in other specific forms without departing from the spirit and essential characteristics thereof. The present embodiments therefore are considered in all respects as illustrative and not restrictive. The scope of the invention is indicated by the appended claims rather than by the foregoing description. All variations, substitutions, and changes that come within the meaning and range of equivalency of the claims therefore are intended to be embraced therein.

What is claimed is:

1. A compression-contact connector assembly comprising:

a housing panel including an array of through-openings;

a plurality of substantially parallel connector units with corresponding attachment ends and opposite contact ends, each of said connector units being disposed within one of the through-openings in said housing panel; and a means for holding the contact ends in a substantially uniform plane;

wherein the attachment ends provide a first electrical coupling between said connector units and interconnect wires on one side of said housing panel;

wherein the contact ends provide a second electrical coupling between said connector units and electronic components disposed on an opposite side of the housing panel; and wherein said connector units and housing are selected in a geometric configuration and a combination of materials to produce a characteristic impedance of the connector assembly that substantially matches an output impedance of a device to an input impedance of devices connected thereto.

2. The connector assembly of claim 1, wherein at least some of said through-openings in the housing panel include an electrically resistive sleeve disposed between the through-opening and the corresponding connector unit.

3. The connector assembly of claim 1, wherein said means for holding the contact ends in a substantially uniform plane consists of a flange assembly that is attached to each of said connector units.

4. The connector assembly of claim 1, wherein said housing panel further comprises an electrically conductive shield for isolating high-frequency e-fields from said connector assembly.

5. The connector assembly of claim 1, wherein said housing panel further comprises a magnetically permeable shield for isolating low frequency h-fields from said connector assembly.

6. The connector assembly of claim 1, wherein at least one of the connector units is a highly conductive material for minimizing electrical power loss from said connector assembly.

7. The connector assembly of claim 1, wherein said connector units are cylindrical.

8. The connector assembly of claim 1, wherein at least one of the connector units is resistive.

9. The connector assembly of claim 1, wherein said electronic components include a device selected from the group consisting of a ball-grid array device, a chip-scale package, a pad on an electric die, a land-grid array, and a flip-chip package.

10. The connector assembly of claim 1, wherein said housing panel further comprises an alignment hole for aligning a guide pin in a mating contact array.

11. The connector assembly of claim 1, wherein said second electrical coupling consists of a solder joint.

12. The connector assembly of claim 1, wherein said second electrical coupling consists of a weld.

13. The connector assembly of claim 1, wherein at least some of said through-openings in the housing panel include a dielectric sleeve disposed between the through-opening and the corresponding connector unit.

14. The connector assembly of claim 2, wherein the connector unit, the dielectric sleeve, and the housing panel form a short segment of coaxial shielding that extends between said one side and said opposite side of the housing panel.

15. An electrical contact-type connector, comprising:

a plurality of resistive elements disposed within a housing, each of said resistive elements including an attachment end for electrical connection with an interconnecting wire and a contact end for electrical contact with an opposing surface; and an alignment means for holding said contact ends in a substantially common plane.

16. The connector assembly of claim 15, wherein at least one of said resistive elements has a planar-shaped, end-facing contact end.

17. The connector assembly of claim 15, wherein at least one of said resistive elements has a concave-shaped, end-facing contact end to form a cavity that extends inwardly from the contact end.

18. The connector assembly of claim 15, wherein at least one of said resistive elements has a convex-shaped, end-facing contact end such as to form a protrusion that extends outwardly from the contact end.

19. The connector assembly of claim 15, wherein at least one of said resistive elements has an end-facing contact end shaped as a coaxial cone that extends outwardly from the contact end to a point.

20. The connector assembly of claim 15, wherein at least one of said resistive elements has an end-facing contact end comprising a noble metal.

21. The connector assembly of claim 15, wherein said housing is magnetically permeable.

22. The connector assembly of claim 15, wherein at least one of said resistive elements is cylindrical.

23. The connector assembly of claim 15, wherein each of said resistive elements is a pin-type separate component connected to said interconnecting wire and said opposing surface only by contact.

24. The connector assembly of claim 15, wherein said housing includes a sleeve adapted to receive one of said resistive elements within the housing.

25. The connector assembly of claim 24, wherein said sleeve is a dielectric material.

26. The connector assembly of claim 24 wherein said sleeve is an electrically resistive material.

27. An electrical contact-type connector, comprising:

a plurality of electrically conductive elements disposed within a housing, each of said conductive elements including an attachment end for electrical connection with an interconnecting wire and a contact end for electrical contact with an opposing surface; and an alignment means for holding said contact ends in a substantially common plane;

wherein each of said conductive elements is a pin-type separate component disposed within a dielectric sleeve in said housing.

28. The connector assembly of claim 27, wherein said sleeve is an electrically resistive material.

29. The connector assembly of claim 27, wherein at least one of said conductive elements has a planar-shaped, end-facing contact end.

30. The connector assembly of claim 27, wherein at least one of said conductive elements has a concave-shaped, end-facing contact end such as to form a cavity that extends inwardly from the contact end.

31. The connector assembly of claim 27, wherein at least one of said conductive elements has a convex-shaped, end-facing contact end such as to form a protrusion that extends outwardly from the contact end.

32. The connector assembly of claim 27, wherein at least one of said conductive elements has an end-facing contact end shaped as a coaxial cone that extends outwardly from the contact end to a point.

33. The connector assembly of claim 27, wherein at least one of said conductive elements has an end-facing contact end comprising a noble metal.

34. The connector assembly of claim 27, wherein said housing is magnetically permeable.

35. The connector assembly of claim 27, wherein at least one of said conductive elements is cylindrical.

* * * * *